United States Patent [19]

Tsutsumi et al.

[11] Patent Number: 4,574,114

[45] Date of Patent: Mar. 4, 1986

[54] PHOTOSENSITIVE COMPOSITION FOR ELECTROPHOTOGRAPHY HAVING POLYVINYL CARBAZOLE AND SILICONE OIL

[75] Inventors: Masahiro Tsutsumi; Toru Nakazawa, both of Osaka; Yasuharu Utsunomiya, Nara, all of Japan

[73] Assignee: Mita Industrial Company, Ltd., Osaka, Japan

[21] Appl. No.: 552,108

[22] Filed: Nov. 16, 1983

[30] Foreign Application Priority Data

Dec. 25, 1982 [JP] Japan ..... 57-228828

[51] Int. Cl.[4] ..... G03G 5/06

[52] U.S. Cl. ..... 430/81; 430/83

[58] Field of Search ..... 430/81, 83

[56] References Cited

U.S. PATENT DOCUMENTS 4,226,928 10/1980 Nakazawa et al. ..... 430/57

4,396,695 8/1983 Dimmler ..... 430/58

*Primary Examiner*—John L. Goodrow

*Attorney, Agent, or Firm*—Lyon & Lyon

[57] ABSTRACT

A photosensitive composition for electrophotography comprising polyvinyl carbazole, a charge-generating organic pigment, and as a sensitizing agent a silicone oil, thereby enhancing the sensitivity of the resulting photosensitive layer and improving the aging characteristic thereof.

12 Claims, 1 Drawing Figure

PHOTOSENSITIVE COMPOSITION FOR ELECTROPHOTOGRAPHY HAVING POLYVINYL CARBAZOLE AND SILICONE OIL

BACKGROUND OF THE INVENTION

1. Field of the Invention

The present invention relates to a photo sensitive composition for electrophotography, having an enhanced sensetivity and an improved aging characteristic.

2. Description of the Prior Art

It is known that a single photosensitive layer is formed by dispersing a charge-generating pigment such as a phthalocyanine pigment, a disazo pigment or a perylene pigment in a charge-transfer medium such as polyvinyl carbazole. Such a conventional photosensitive layer, especially, a layer formed by dispersing a perylene pigment in polyvinyl carbazole, has low sensitivity and is thus unpractical. Although, in order to improve the sensitivity of such a photosensitive layer of the charge-transfer medium and charge-generating pigment system, a variety of sensitizing agents are generally introduced into the system. However, the resulting layer still exhibits a low sensitivity, and an insufficient charged voltage and/or a decrease in the surface potential due to repeated light exposure (known as aging).

On the other hand, it is generally difficult to uniformly disperse the charge-generating pigment in polyvinyl carbazole.

SUMMARY OF THE INVENTION

The present invention was completed based on the knowledge that, when a silicone oil is incorporated as a sensitizing agent in a dispersion system comprising polyvinyl carbazole and a charge-generating organic pigment, not only a prominent increase of the sensitivity but also a remarkable improvement of the aging characteristic can be attained.

Therefore, the photosensitive composition for electrophotography of this invention, which overcomes the above-discussed and numerous other drawbacks and deficiencies of the prior art, relates to a photosensitive composition comprising polyvinyl carbazole, a charge-generating organic pigment and as a sensitizing agent a silicone oil.

The silicone oil, the hinematic viscosity of which is preferably more than 20 centistokes, is contained in an amount of 0.1 to 10 parts by weight per 100 parts by weight of polyvinyl carbazole.

Thus, the invention described herein makes possible the objects of (a) providing a photosensitive composition for electrophotography which has an enhanced sensitivity; and (b) providing a photosensitive composition for electrophotography in which the reduction of the surface potential due to the repeated light exposure is surprisingly decreased (the aging characteristic is remarkably improved).

BRIEF DESCRIPTION OF THE DRAWINGS

This invention may be better understood and its numerous objects and advantages will become apparent to those skilled in the art by reference to the accompanying drawing as follows.

DESCRIPTION OF THE PREFERRED EMBODIMENTS

Figure 1:
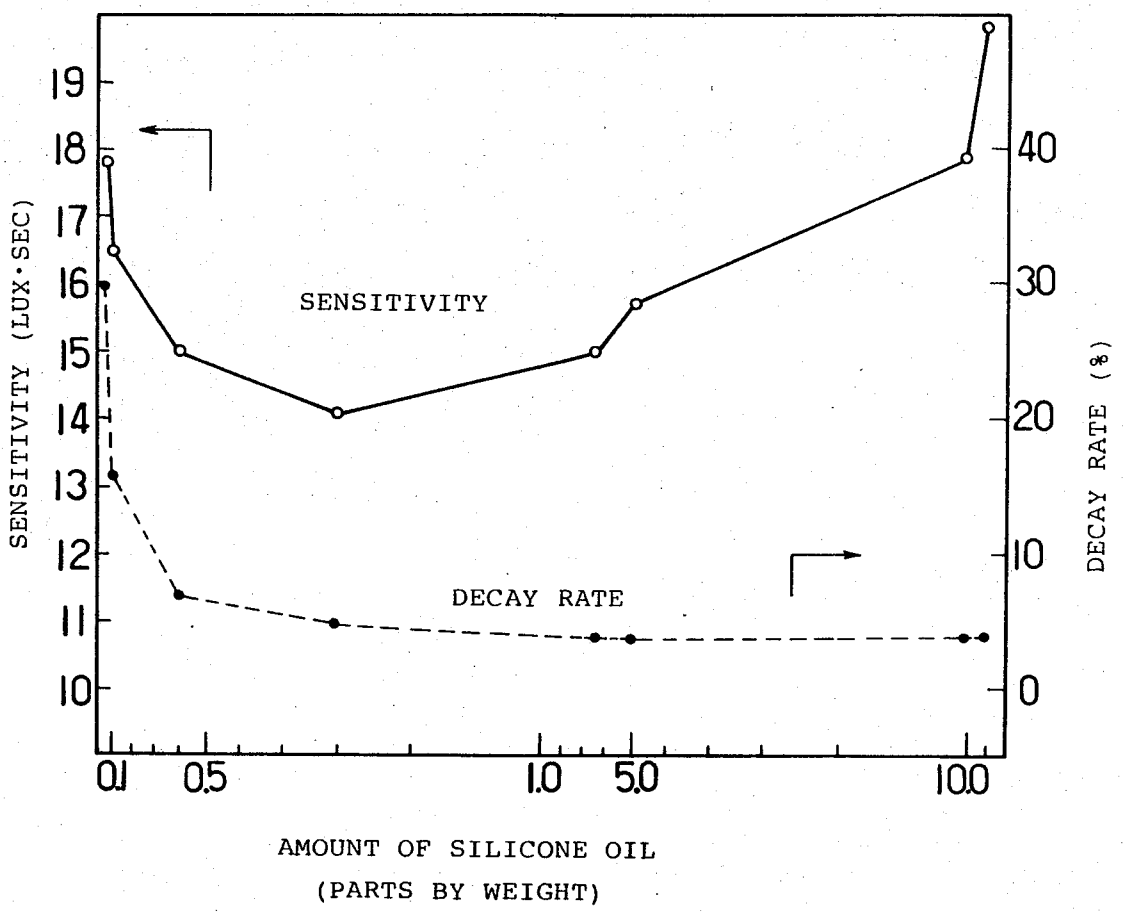
FIG. 1 shows the relationship between the amount of silicone oil to be added and the sensitivity and the decay rate of each photosensitive layer according to this invention.

The polyvinyl carbazole to be used in this invention is a polymer, a film-productive and electron donor resin, having the following nuclear unit (1):

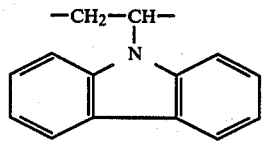

(1)

Polyvinyl carbozole derivatives, in which substituents such as halogen or nitro group are introduced into the above-mentioned aromatic nucleus, may be also employed in this invention.

The charge-generating organic pigment to be used in this invention is, for example, a perylene pigment, a bisazo pigment, a pyranthrone pigment, a phthalocyanine pigment, a quinacridone pigment, an indanthrene pigment, an anthraquinone pigment, a thioindigo pigment, a perynone pigment or the like. Especially, the perylene pigment represented by the following formula (2) is preferable:

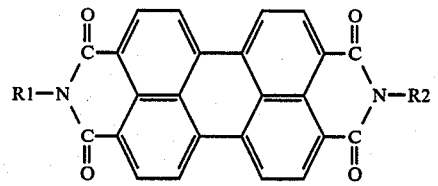

(2)

Wherein R1 and R2 are hydrogen or a substituted or unsubstituted alkyl or aryl group, respectively.

Examples of the substituents thereof are hydroxy, alkoxy, amino, nitro or halogen.

A preferable perylene pigment is at least one selected from the group consisting of N.N'-dimethylperylene-3.4.9.10-tetracarboxylic acid diimide, N.N'-di(3.5-dimethylphenyl)perylene-3.4.9.10-tetracarboxylic acid diimide, N.N'-di(4-ethoxyphenyl)perylene-3.4.9.10-tetracarboxylic acid diimide and N.N'-di(4-toluyl)perylene-3.4.9.10-tetracarboxylic acid diimide, although perylene pigments used in this invention are not limited to those exemplified above.

The above-mentioned charge-generating pigment is contained in an amount of 1 to 40 parts by weight, preferably 5 to 20 parts by weight, per 100 parts by weight of polyvinyl carbazole. When the amount of the pigment is too small, the sensitivity of the resulting photosensitive composition is insufficient. When the amount of the pigment is in excess, the initial saturation charged voltage tends to reduce with the reduced sensitivity.

According to a preferred embodiment of this invention, charge-generating pigments other than described above are used in a combination form; for example, phthalocyanine pigments and/or disazo pigments are added to the perylene pigment. When a pigment having a sensitivity to red color wavelength is used in an amount of 2 to 10 parts by weight per 100 parts by weight of the perylene pigment, the sensitivity to the red color wavelength region of the resulting photosensitive layer can be rendered panchromatic.

An example of the silicone oil used in this invention is an oily organopolysiloxane, a kind of water repellent or release agent, having a substantially straight-chain structure of a linkage of one or more siloxane units represented by the formula (3) and the structure is closed by a mono-functional siloxy group such as trimethyl siloxy, dimethylmethoxy siloxy, or the like at its both ends:

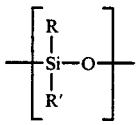

(3)

Wherein R is alkyl such as methyl, ethyl or propyl, or aryl such as phenyl; and R′ is alkyl, alkenyl, aryl, hydrogen, lower alkoxy, amino alkyl, hydroxy alkyl, polyalkyleneoxy or polyalkyleneoxy alkyl.

Examples of organopolysiloxane are dimethyl polysiloxane, methylhydrodiene polysiloxane, methylphenyl polysiloxane, methylmethoxy polysiloxane, 3-aminopropylmethyl polysiloxane, 2-hydroxyethylmethyl polysiloxane, dimethyl siloxane-polyoxyethylene copolymer, and copolymers of the above. Used preferable are polydimethyl siloxane, polymethyl-phenyl siloxane and the like, although an organopolysiloxane having a polar or functional group such as methylhydrodiene siloxane, methylmethoxy siloxane, 3-aminopropylmethyl siloxane or the like may be employed for this invention.

According to this invention, the silicone oil contained ranges in amount from 0.1 to 10 parts by weight, preferably 0.2 to 4 parts by weight, per 100 parts by weight of polyvinyl carbazole, so that the sensitivity of the resulting photosensitive composition increases remarkably. When the amount of silicone oil is incorporated beyond the above-mentioned range, the sensitivity intends to decrease gradually. The aging characteristic of the photosensitive composition is improved as well by the addition of silicone oil; that is, the reduction of the surface potential due to the light exposure is decreased. The surface potential becomes stable beyond a certain amount of silicone oil and unaltered in spite of a further addition of silicone oil. Thus, when the amount of the silicone oil is too small, both the sensitivity and the aging characteristic decrease. When the amount of the silicone oil is in excess, the sensitivity is so lowered that the objects of this invention cannot be attained.

Moreover, the silicone oil used in this invention preferably has a kinematic vsicosity of more than 20 centistokes. When the viscosity is too small, the silicone oil exhibits a cohesion or aggregation thereby dispersing insufficiently the organic pigments in polyvinyl calbazole, resulting in incomplete effects of sensitivity and rapid aging.

With respect to improved dispersion of the pigments due to the addition of the silicone oil to the polyvinyl carbazole-organic pigment system with an improvement in sensitivity and aging, it can be presumed that when an amount of the silicone oil is added to the disperse system with the charge-transfer medium and the charge-generating organic pigment, the wetting is improved at the interface between the medium and the pigment particles with an improved dispersion of the pigment into the charge-transfer medium so that the surfaces of the pigment particles come into contact with the charge-transfer medium thereby creating an increased contact area therebetween. As a result, the electric charge is efficiently transferred at the interface between the pigment particles and the medium thereby enabling to attain an enhanced sensitivity. Additionally, since the surfaces of the pigment particles come into contact with the medium, less electric charge is trapped at the interface between the pigment particles and the medium so that the charge is less accumulated thereon even though the charging process and an exposure process are repeated, thereby avoiding a reduction in the surface potential.

For the purpose of a further enhancement of the sensitivity, known electron acceptors may be incorporated in an amount of 0.5 to 40 parts by weight per 100 parts by weight of polyvinyl carbazole. As these electron acceptors, carboxylic acid anhydrides; compounds having electron-acceptor-type-nuclear structure such as ortho- or para-quinoid; and alicyclic, aromatic or polycyclic compounds having electron-acceptor-type-substituents such as nitro, nitroso, cyano, or the like may be used. In particular, there may be maleic anhydride, phthalic anhydride, tetrachlorophthalic anhydride, tetrabromphthalic anhydride, naphthalic anhydride, pyromellitic anhydride, 5.8-dichloronaphthoquinone, 2.3-dichloro-1.4-naphthoquinone, o-chloroanil, o-bromanil, p-chloranil, p-bromanil, p-iodoanil, tetracyanoquinodimethane, 5.6-quinolinedione, cumarin-2.2-dione, oxyindirubin, oxyindigo, 1.2-dinitroethane, 2.2-dinitropropane, 2-nitro-2-nitrosopropane, iminodiacetonitrile, succinonitrile, tetracyanoethylene, 1.1.3.3-tetracyanopropenide, o-, m- or p-dinitrobenzene, 1.2.3-trinitrobenzene, 1.2.4-trinitrobenzene, 1.3.5-trinitrobenzene, dinitrodibenzyl, 2.4-dinitroacetophenone, 2.4-dinitrotoluene, 1.3.5-trinitrobenzophenone, 1.2.3-trinitroanisole, $\alpha.\beta$-dinitronaphthalin, 1.4.5.8-tetranitronaphthalin, 3.4.5-trinitro-1.2-dimethylbenzene, 3-nitroso-2-nitrotoluene, 2-nitroso-3.5-dinitrotoluene, o-, m- or p-nitronitrosobenzene, phthalonitrile, terephthalonitrile, isophthalonitrile, benzoylcyanide, bromobenzylcyanide, quinollcyanide, o-xylylenecyanide, o-, m- or p-nitrobenzylcyanide, 3.5-dinitropyridine, 3-nitro-2-pyridone, 3.4-dicyano pyridine, $\alpha$-, $\beta$- or $\gamma$-cyanopyridine, 4.6-dinitroquinone, 4-nitroxanthone, 9.10-dinitroanthracene, 1-nitroanthracene, 2-nitrophenanthrenequinone, 2.5-dinitrofluorenone, 2.6-dinitrofluorenone, 3.6-dinitrofluorenone, 2.7-dinitrofluorenone, 2.4.7-trinitrofluorenone, 2.4.5.7tetranitrofluorenone, 3.6-dinitrofluorenonemandenonitrile, 3-nitrofluorenonemandenonitrile, tetracyanopyrene, or the like.

In order to increase the mechanical strength of the photosensitive layer and improve the adhesion to a conductive substrate, a resin binder having no photoconductivity, for example, a polyester resin, an epoxy resin, a polycarbonate resin, a polyurethane resin, a xylene resin, an acrylic resin or a styrene-butadiene copolymer may be used. This binder may be used in an amount of 0.1 to 50 parts by weight, preferably 10 to 30 parts by weight, per 100 parts by weight of polyvinyl carbazole.

The photosensitive composition according to this invention is coated as a layer having a certain thickness on a conductive substrate and used in the form of a photoconductor for electrophotography.

As the conductive substrate, foil, a plate, a sheet or drum of a metal such as aluminum, copper, tin or tinplate may be used. Moreover, a substrate prepared by depositing a metal such as mentioned above on a film base such as a biaxially stretched polyester film or a glass sheet by vacuum evaporation deposition, sputtering or non-electrolystic plating may be used. Moreover, Nesa glass as the conductive substrate may also be used.

The coating composition is prepared by dispersing the charge-generating pigment in a solvent suitable for polyvinyl carbazole such as tetrahydrofuran, dichloroethane or toluene-cyclohexanone by ultrasonic vibration or high shearing agitation and adding polyvinyl carbazole and silicone oil, optionally with a sensitizing agent and a resin, to the dispersion. The resulting coating preferably has a solid concentration ranging from 5 to 12% by weight in light of the adaptability to the coating operation.

It is preferred that the thickness of the layer of the photosensitive composition after drying the 3 to 30 μm, more preferably 8 to 15 μm from the viewpoint of the electrophotographic characteristics.

The photosensitive composition of the present invention exhibits an excellent sensitivity whether it may be subjected to positive charging or negative charging. However, if the photosensitive layer is subjected to positive charging and then subjected to imagewise light exposure, a further enhanced sensitivity can be obtained.

The present invention will be described in detail with reference to the following Examples that do not intend to limit the scope of this invention.

EXAMPLE 1

(a) Preparation of the sample photosensitive layer: Eight parts by weight of N.N'-di(3.5-dimethylphenyl)-perylene was dispersed in 150 parts by weight of tetrahydrofuran within a stainless ball-mill rotating at 80 rpm overnight. To the dispersion in the ball-mill, 20 parts by weight of 2.3-dichloro-1.4-naphthoquinone, 10 parts by weight of polyester resin (Vylon 200 supplied by Toyobo Co.) and 100 parts by weight of polyvinyl carbazole were added with 0.1 parts by weight of silicone oil having a hinematic viscosity of 50 centistokes, followed by a uniform dispersion with the further rotation of the ball-mill at 80 rpm overnight. The resulting photosensitive coating was coated on an aluminum sheet having a thickness of 80 μm by a coating wire bar and dried at 100° C. for 1 hour, followed by standing in the dark overnight, with formation of a photosensitive layer having a thickness of 15 μm.

(b) Examination of various characteristics of the sample layer:

(b.1) Sensitivity: The sensitivity of the sample photosensitive layer was examined by an electrostatic paper analyzer (supplied by Kawaguchi Denki Co., Ltd.) under the following conditions:

Examination Mode: Stat 2,

Impression Voltage: +6.0 Kvolt, and

Exposure Quantity: White Tungsten Lamp 40 luxes

The sensitivity determined was represented by the exposure quantity (lux·second) for half decay of the potential. The smaller the value of the exposure quantity for half decay of the potential, the higher is the sensitivity. The results are shown in Table 1 and FIG. 1.

(b.2) Decay Rate: The sample layer was applied to an electrophotographic copying machine DC-191 (supplied by Mata Industries Co., Ltd.) wherein the impression voltage was set up at +7.4 kvolt and a charging-discharging (exposure) process was repeated 1000 times. The decay rate of the sample photosensitive layer was calculated by the following formula (4)

$$\text{Decay rate (\%)} = \frac{V1 - V2}{V1} \times 100 \quad (4)$$

Wherein V1 and V2 are a surface voltage at the first and the 1000th cycle, respectively. The nearer to zero the value of the decay rate, the less is the exhaustion of the photosensitive layer. The results are shown in Table 1 and FIG. 1.

EXAMPLE 2

Preparation and examination of the sample layer were carried out in the same manner as described in Example 1 except that the amount of silicone oil was 0.4 parts by weight instead of 0.1 parts by weight per 100 parts by weight of polyvinyl carbazole.

EXAMPLE 3

Preparation and examination of the sample layer were carried out in the same manner as in Example 1 except that the amount of silicone oil was 0.8 parts by weight instead of 0.1 parts by weight per 100 parts by weight of polyvinyl carbazole.

EXAMPLE 4

Preparation and examination of the sample layer were carried out in the same manner as in Example 1 except that the amount of silicone oil was 2.5 parts by weight instead of 0.1 parts by weight per 100 parts by weight of polyvinyl carbazole.

EXAMPLE 5

Preparation and examination of the sample layer were carried out in the same manner as in Example 1 except that the amount of silicone oil was 5.0 parts by weight instead of 0.1 parts by weight per 100 parts by weight of polyvinyl carbazole.

EXAMPLE 6

Preparation and examination of the sample layer were carried out in the same manner as in Example 1 except that the amount of silicone oil was 10.0 parts by weight instead of 0.1 parts by weight per 100 parts by weight of polyvinyl carbazole.

Control 1

Preparation and examination of the sample layer were carried out in the same manner as in Example 1 except that the amount of silicone oil was zero instead of 0.1 parts by weight per 100 parts by weight of polyvinyl carbazole.

Control 2

Preparation and examination of the sample layer were carried out in the same manner as in Example 1 except that the amount of silicone oil was 20.0 parts by weight instead of 0.1 parts by weight per 100 parts by weight of polyvinyl carbazole.

TABLE 1

| | | Amount of Silicone Oil (part by weight per 100 parts by weight of PVK) | Sensitivity (lux sec) | Decay Rate (%) |
|---|---|---|---|---|
| Example | 1 | 0.1 | 16.5 | 16.0 |
| | 2 | 0.4 | 15.0 | 7.0 |
| | 3 | 0.8 | 14.1 | 5.0 |
| | 4 | 2.5 | 15.0 | 4.0 |
| | 5 | 5.0 | 15.7 | 4.0 |
| | 6 | 10.0 | 17.8 | 4.0 |
| Control | 1 | 0 | 17.8 | 30.0 |
| | 2 | 20.0 | 19.9 | 4.0 |

We claim:

1. A photosensitive composition for electrophotography, comprising:

a single photoconductive layer of a uniform dispersion of polyvinyl carbazole, a charge-generating organic pigment, and as a sensitizing agent a silicone oil.

2. A photosensitive composition according to claim 1, wherein said charge-generating organic pigment is at least one selected from the group consisting of a perylene pigment, a bisazo pigment, a pyranthrone pigment, a phthalocyanine pigment, a quinacridone pigment, an indanthrene pigment, an anthraquinone pigment, a thioindigo pigment and a perynone pigment.

3. A photosensitive composition according to claim 1, wherein said charge-generating pigment is a perylene pigment represented by the general formula:

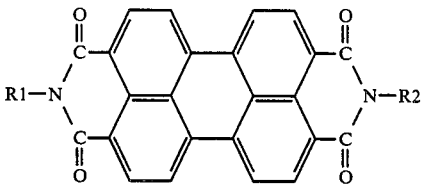

wherein R1 and R2 are hydrogen or a substituted or unsubstituted alkyl or aryl group, respectively.

4. A photosensitive composition according to claim 3, wherein said perylene pigment is at least one selected from the group consisting of N.N'-dimethylperylene-3.4.9.10-tetracarboxylic acid diimide, N.N'-di(3.5-dimethylphenyl)perylene-3.4.9.10-tetracarboxylic acid diimide, N.N'-di(4-ethoxyphenyl)perylene-3.4.9.10-tetracarboxylic acid diimide and N.N'-di(4-toluyl)perylene-3.4.9.10-tetracarboxylic aciddiimide.

5. A photosensitive composition according to any one of claims 1–4, wherein said charge-generating pigment is contained in an amount of 1 to 40 parts by weight per 100 parts by weight of polyvinyl carbazole.

6. A photosensitive composition according to claim 1 or claim 2, which further comprises a phthalocyanine pigment or a disazo pigment in an amount of 2 to 10 parts by weight per 100 parts by weight of the perylene pigment.

7. A photosensitive composition according to claim 1, wherein said silicone oil is contained in an amount of 0.1 to 10 parts by weight per 100 parts by weight of polyvinyl carbazole.

8. A photosensitive composition according to claim 1, wherein said silicone oil has a kinematic viscosity of more than 20 centistokes.

9. A photosensitive composition according to claim 1, wherein said silicone oil is an organopolysiloxane.

10. A photosensitive composition according to claim 1, which further comprises an electron acceptor in an amount of 0.5 to 40 parts by weight per 100 parts by weight of polyvinyl carbazole.

11. A photosensitive composition according to claim 10, wherein said electron acceptor is at least one selected from the group consisting of carboxylic acid anhydrides; compounds having electron-acceptor-type-nuclear structure, and alicyclic, aromatic or polycyclic compounds having electron-acceptor-type-substituents.

12. A photosensitive composition according to claim 1, which further comprises a resin binder having no photoconductivity in an amount of 0.1 to 50 parts by weight per 100 parts by weight of polyvinyl carbazole.

* * * * *